US005772206A

United States Patent [19]

Pfutzenreuter

[11] Patent Number: 5,772,206

[45] Date of Patent: Jun. 30, 1998

[54] AMUSEMENT GAME HAVING A SOLENOID OPERATED PLAY FEATURE

[75] Inventor: William C. Pfutzenreuter, Arlington Heights, Ill.

[73] Assignee: Capcom Coin-Op Inc., Arlington Heights, Ill.

[21] Appl. No.: 712,448

[22] Filed: Sep. 11, 1996

[51] Int. Cl.[6] ..... A63F 7/22

[52] U.S. Cl. ..... 273/129 S; 273/129 V; 273/121 A; 273/118 A

[58] Field of Search ..... 335/255, 282, 335/276; 273/118 A, 119 A, 121 A, 129 R, 129 S, 129 V

[56] References Cited

U.S. PATENT DOCUMENTS

| | | | |
|---|---|---|---|
| 521,269 | 6/1894 | Michl | 335/282 |
| 3,391,937 | 7/1968 | Seiden | 273/129 V |
| 3,404,888 | 10/1968 | Lally et al. | 273/129 V |
| 4,398,718 | 8/1983 | Wiczer | 273/129 V |
| 4,498,670 | 2/1985 | Peters | 273/129 V |
| 5,112,551 | 5/1992 | Hylak et al. | 264/219 |
| 5,297,793 | 3/1994 | DeMar et al. | 273/129 V |
| 5,546,064 | 8/1996 | Sallam et al. | 335/255 X |

FOREIGN PATENT DOCUMENTS

| | | | |
|---|---|---|---|
| 237503 | 10/1988 | Japan | 335/255 |
| 17688 | of 1891 | United Kingdom | 335/255 |
| 2145879 | 4/1985 | United Kingdom | 335/255 |

OTHER PUBLICATIONS

Knowlton, "Standard Handbook for Electrical Engineers" 1941; pp. 479–487.

*Primary Examiner*—Raleigh W. Chiu
*Attorney, Agent, or Firm*—Gary R. Jarosik

[57] ABSTRACT

An amusement game having a solenoid operated rotating play feature. The solenoid comprises a bobbin having a bore around which is disposed electrical windings for use in creating an electromagnetic force and a plunger disposed within the bore. The plunger is linked to the rotating play feature and is movable in response to the electromagnetic force. The bore and the plunger are sized and arranged to allow the plunger to move laterally within the bore to accomodate the rotational movement of the play feature as the plunger moves in response to the electromagnetic force. An unhanded bracket is supplied to mount the play feature to the playing surface of the amusement game which is adaptable to carry a variety of end-of-stroke sensing switches.

16 Claims, 3 Drawing Sheets

AMUSEMENT GAME HAVING A SOLENOID OPERATED PLAY FEATURE

BACKGROUND OF THE INVENTION

This invention relates generally to amusement games and, more particularly, relates to an amusement game having a solenoid operated play feature.

Amusement games of the type having an inclined playing surface over which a rolling ball may travel are known in the art and are typically referred to as pinball games. On the playing surface targets are provided and at least one is movable and coupled to an electrical switch. During the course of play, it is the object of the player to use a flipper mechanism to direct a rolling ball across the playing surface and into contact with the target to achieve a game objective. Typically, both a right handed and a left handed flipper mechanism are associated with the playing surface for use in directing the rolling ball.

Currently such flipper mechanisms, and other similarly movable play features, are constructed with a solenoid having a linearly movable solenoid plunger which is linked to the play feature to cause the rotation thereof. However, since the play feature travels in an arcuate path and the solenoid plunger follows a linear path, an extra, movable link is required to be pivotally connected between each of the two devices in order to allow the linear motion of the solenoid plunger to be translated into the rotational motion of the play feature. An example of such a linkage may be seen in U.S. Pat. No. 5,112,551 to Hylak et al. entitled "Method of Molding an Improved Linkage Lever" which issued May 12, 1992. Unfortunately, this extra, movable link is subjected to most of the stress associated with the movement of the play feature and, accordingly, suffers an unacceptable rate of breakage.

It is also known in the art to utilize a solenoid having a plunger which rotates as it follows a linear path into the solenoid housing. This linear movement of the plunger is utilized to affectuate movement of a play feature. Such devices are, however, expensive and generally lack sufficient strength to be utilized in connection with ball moving play features such as flippers.

The brackets which are currently used to mount the flipper mechanisms to the playing surface are arranged to carry the components thereof in such a manner that separate brackets are needed to implement both right handed and left handed uses thereof. This is seen to require the stocking of extra parts and, accordingly, an undesirable increase in the manufacturing cost of the amusement game. Furthermore, the use of a link requires a larger footprint for the brackets which limits the space on the playing surface to which other features may be mounted.

From the foregoing, it is seen that a need exists for an improved solenoid operated amusement game play feature, in particular, and improved flipper mechanism.

As a result of this existing need, it is an object of the present invention to provide an improved, rotating, solenoid operated amusement game play feature in which the need to use an extra link is eliminated.

It is a further object of the present invention to provide an improved solenoid operated amusement game play feature which requires less moving parts.

It is another object of the present invention to provide a solenoid operated amusement game play feature, in particular, a flipper mechanism, which is more efficient in design.

It is still a further object of the present invention to provide a solenoid operated amusement game play feature which has a smaller footprint.

It is yet another object of the present invention to provide an unhanded bracket for use in mounting the solenoid operated amusement game play feature to the playing surface.

SUMMARY OF THE INVENTION

In accordance with these objectives, the present invention resides in an amusement game having a solenoid operated rotating play feature. The solenoid comprises a bobbin having a bore around which is disposed electrical windings for use in creating an electromagnetic force and a plunger disposed within the bore. The plunger is linked to the rotating play feature and is movable in response to the electromagnetic force. The bore and the plunger are sized and arranged to allow the plunger to follow a generally arcuate path as the plunger moves in response to the electromagnetic force. More specifically, the bore is provided with an inner diameter which is larger than that provided to the plunger such that the plunger is free to move laterally in order to accomodate the rotational movement of the play feature. An unhanded bracket is supplied to mount the play feature to the playing surface of the amusement game which is adaptable to carry a variety of end-of-stroke sensing switches.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiments shown in the following drawings in which.

DETAILED DESCRIPTION

Figure 1:
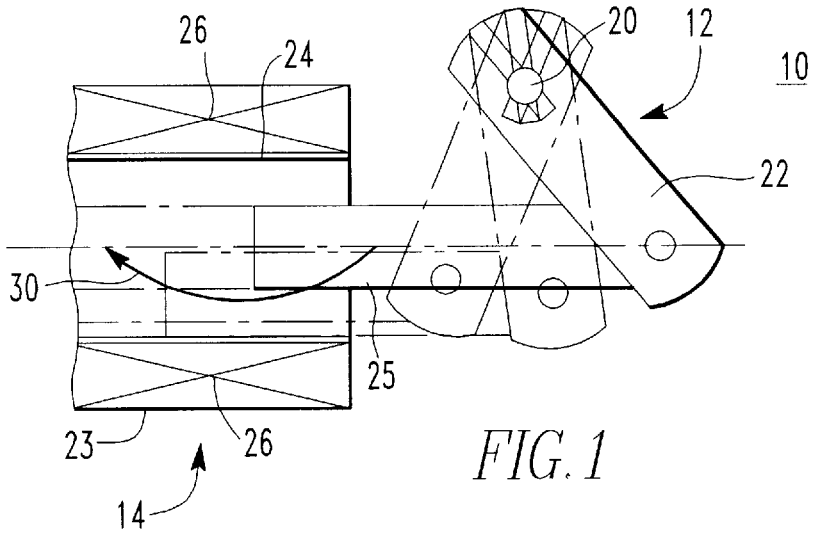
FIG. 1 illustrates a top view of the solenoid operated play feature which is the subject of the present invention.
Figure 2:
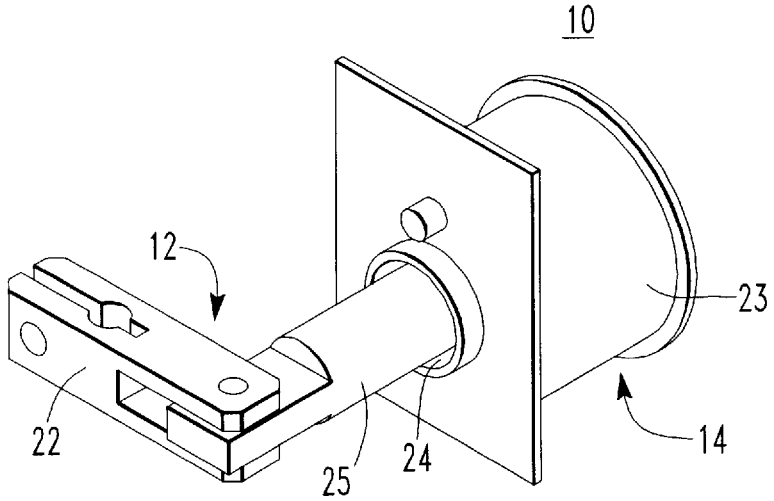
FIG. 2 illustrates an isometric view of the play feature illustrated in FIG. 1.

While the invention can be used in connection which any type of rotating play feature in an amusement game, it will be described hereinafter in the context of a solenoid operated flipper mechanism for use in an amusement game of the pinball variety as the preferred embodiment thereof.

Referring now to the figures, where like reference numerals represent like elements, a solenoid operated amusement game play feature 10 is illustrated which generally comprises a flipper bat assembly 12 which is movably linked to a solenoid 14. The flipper bat assembly includes a flipper bat (not shown) which is disposed above the playing surface of the amusement game and which is rotatable for imparting a motive force upon a rolling ball. More specifically, the flipper bat is rotatable about a pivot post 20 to which it is connected. The pivot post 20 extends through the playing surface and is connected thereunder to a pivot arm 22 which is used to cause the rotation thereof.

The solenoid 14 comprises a bobbin 23 having a bore 24 in which is disposed a solenoid plunger 25. The bore 24 is configured to have a diameter which is larger than the diameter of the plunger 25 for reasons which will be discussed hereinafter. As will be understood by those skilled in the art, the solenoid plunger 25 is movable in response to an electromagnetic force which is generated by electrical windings 26. In the preferred embodiment, the electrical windings 26 is formed with 24GA wire with approximately 900 turns at approximately 6–7 Ohms. A spring (not shown) functions to bias the plunger 25 in an extended position when the electrical windings 26 are deactivated. A seat (also not shown) is utilized to limit the movement of the plunger 25 when the plunger is caused to move inward in response to the electromagnetic force. The solenoid plunger 25 is pivotally connected at one end thereof directly to the flipper bat assembly 12, in particular, to the pivot arm 22.

During operation, when the plunger 25 is caused to be drawn inward by the electromagnetic force generated by the electrical windings 26, the plunger 25 will pull upon the pivot arm 22 causing the rotation of the pivot post 20 and the flipper bat attached thereto. Specifically, the electromagnetic force applied to the plunger 25 will maintain the plunger 25 in substantial parallel alignment with the longitudinal axis of the bore 24 as the plunger moves inward. Meanwhile the longitudinal axis of the plunger 25 will first move laterally away from the longitudinal axis of the bore 24 and, thereafter, move laterally towards the longitudinal axis of the bore 24 as the stroke is completed. As best seen in FIG. 1, this combined lateral motion of the plunger 25 results in the plunger following a generally arcuate path 30. In this manner, the larger inner diameter supplied to the bore 24 allows the plunger 25 to accommodate the rotational movement of the pivot arm 22.

To mount the play feature 10 to the underside of the playing surface a unhanded bracket 40 is used. The bracket 40, illustrated in FIGS. 2–5, is used to carry both the solenoid 14 and the flipper bat assembly 12. Specifically, the solenoid 14 is carried between a first projecting bracket wall 42 and a second projecting bracket wall 44. Meanwhile, the base 46 of the bracket 40 has a pair of apertures through which the pivot post 20 extends. A fastener 50 is used to maintain the pivot post 20 within the aperture 48. The pair of apertures 48 are arranged to be on opposite sides of the base 46 whereby the pivot post 22 can be inserted through the appropriate aperture 48 to achieve either a right handed or left handed play feature assembly. It is noted that the illustrated configuration is arranged to provide a right handed flipper assembly.

Figure 3:
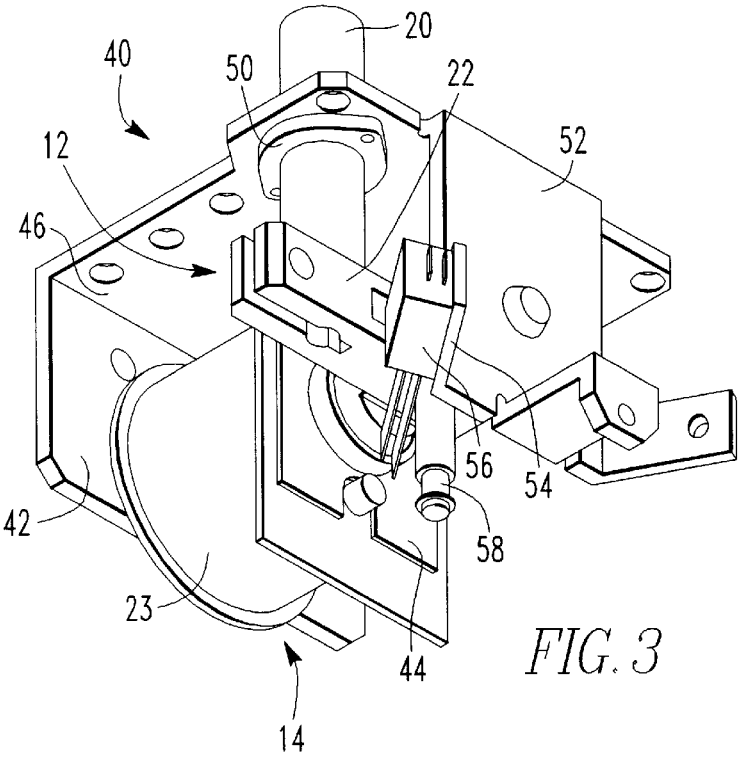
FIG. 3 illustrates an isometric view of a further embodiment of the play feature illustrated in FIGS. 1 and 2.

In a further embodiment of the present invention, illustrated in FIG. 3, the bracket 40 is provided with a third projecting bracket wall 52 from which extends a projection 54. The third projecting bracket wall 52 primarily functions to limit the extension of the plunger 25 as a result of the bias applied by the spring. The projection 54 is provided to carry an end-of-stroke detecting leaf switch 56 which is arranged to cooperate with an extension 58, associated with the pivot arm 22, which is connected to the flipper bat assembly 12 to track the motion thereof. As will be understood by those skilled in the art, the leaf switch 56 is arranged to be closed by the extension 58 when the plunger 25 completes its stroke into the bobbin 23.

Figure 4:
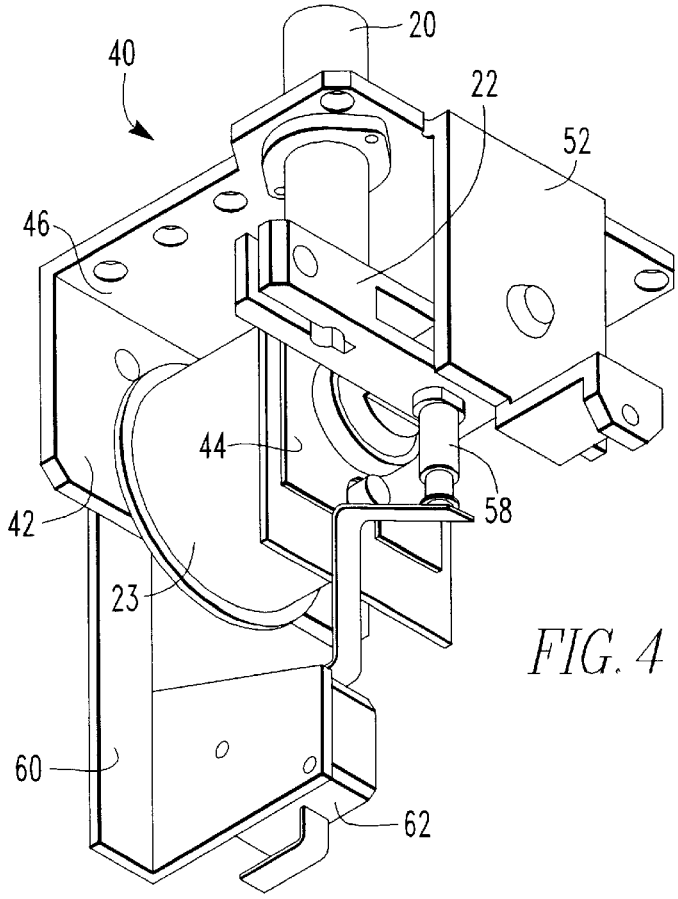
FIG. 4 illustrates an isometric view of another embodiment of the play feature illustrated in FIGS. 1 and 2.

In another embodiment of the present invention, illustrated in FIG. 4, the first projecting bracket wall 42 is provided with a bracket wall extension 60. The bracket wall extension 60 is used to support an end-of-stroke micro switch 62. The micro switch 62 is arranged to cooperate with the extension 58 to detect when the plunger 25 completes its stroke into the bobbin 23.

Figure 5:
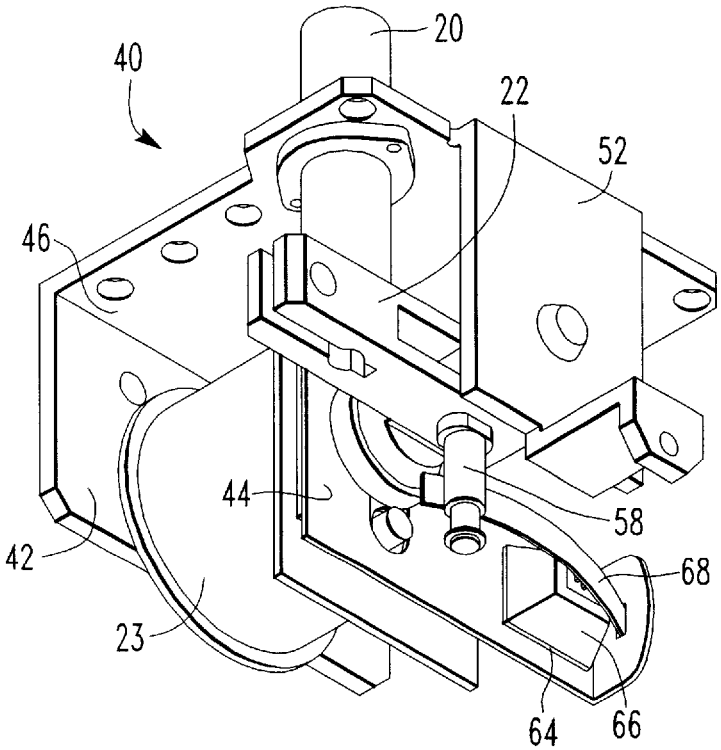
FIG. 5 illustrates an isometric view of yet another embodiment of the play feature illustrated in FIGS. 1 and 2.

In a yet another embodiment of the present invention, illustrated in FIG. 5, the second projecting bracket wall 44 is provided with a bracket wall extension 64. The bracket wall extension 64 is used to support an end-of-stroke keyboard switch 66 and a movable arm 68. The movable arm is arranged to close the keyboard switch 66 when the plunger 25 completes its stroke into the bobbin 23.

It should be apparent from the preceding description that this invention has, among other advantages, the advantage of providing a solenoid operated amusement game play feature carried by an unhanded bracket in which the movement of the solenoid plunger of the operating solenoid may be directly translated to the rotating play feature without the necessity of utilizing a link required to convert linear motion to rotational motion.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. An amusement game, comprising:

a rotating play feature;

a solenoid comprising a bobbin having a bore around which is disposed electrical windings for use in creating an electromagnetic force; and a plunger disposed within said bore and linked to said rotating play feature, said plunger being movable in response to said electromagnetic force;

wherein said bore and said plunger are sized and arranged to allow said plunger to move laterally as said plunger moves in response to said electromagnetic force.

2. The amusement game as recited in claim 1, wherein said plunger follows a generally arcuate path as said plunger moves in response to said electromagnetic force.

3. The amusement game as recited in claim 1, wherein said play feature comprises a flipper assembly.

4. The amusement game as recited in claim 1, further comprising an unhanded bracket adapted to carry said play feature and said solenoid.

5. The amusement game as recited in claim 1, further comprising an end-of-stroke switch for sensing when said plunger has finished its stroke into said bore.

6. The amusement game as recited in claim 5, wherein said end-of-stroke switch comprises a leaf switch.

7. The amusement game as recited in claim 5, wherein said end-of-stroke switch comprises a micro switch.

8. The amusement game as recited in claim 5, wherein said end-of-stroke switch comprises a keyboard switch.

9. A play feature for an amusement game, comprising:

a rotable post;

a pivot arm connected to said post;

a solenoid comprising a bobbin having a bore around which is disposed electrical windings for use in creating an electromagnetic force; and a plunger disposed within said bore and linked to said pivot arm, said plunger being movable in response to said electromagnetic force;

wherein said bore and said plunger are sized and arranged to allow said plunger to move laterally as said plunger moves in response to said electromagnetic force.

10. The play feature as recited in claim 9, wherein said plunger follows a generally arcuate path as said plunger moves in response to said electromagnetic force.

11. The play feature as recited in claim 9, further comprising a flipper bat attached to said post.

12. The play feature as recited in claim 9, further comprising an unhanded bracket adapted to carry said post and said solenoid.

13. The play feature as recited in claim 9, further comprising an end-of-stroke switch for sensing when said plunger has finished its stroke into said bore.

14. The play feature as recited in claim 13, wherein said end-of-stroke switch comprises a leaf switch.

15. The play feature as recited in claim 13, wherein said end-of-stroke switch comprises a micro switch.

16. The play feature as recited in claim 13, wherein said end-of-stroke switch comprises a keyboard switch.

* * * * *